US005109684A

United States Patent [19]

Grandy, Sr.

[11] Patent Number: 5,109,684

[45] Date of Patent: May 5, 1992

[54] CHANGEABLE ROTARY COMBINATION SHACKLE LOCK

[75] Inventor: Kenneth N. Grandy, Sr., South Milwaukee, Wis.

[73] Assignee: Master Lock Company, Milwaukee, Wis.

[21] Appl. No.: 687,265

[22] Filed: Apr. 18, 1991

Related U.S. Application Data

[63] Continuation of Ser. No. 472,693, Jan. 31, 1990, abandoned.

[51] Int. Cl.[5] ..... E05B 37/06

[52] U.S. Cl. ..... 70/25; 70/312

[58] Field of Search ..... 70/20-22, 70/24, 25, 26, 312

[56] References Cited

U.S. PATENT DOCUMENTS

| | | | |
|---|---|---|---|
| 1,486,934 | 3/1924 | Strmic | 70/25 |
| 1,666,453 | 4/1928 | Jakopets | 70/25 |
| 1,706,994 | 3/1929 | Beck | 70/312 |
| 1,898,947 | 2/1933 | Frey | 70/312 |
| 2,189,342 | 2/1940 | Eber | 70/312 |
| 4,354,365 | 10/1982 | Mayer et al. | 70/30 |
| 4,441,346 | 4/1984 | Castiglioni | 70/312 |
| 4,445,348 | 5/1984 | Saitoh | 70/312 |
| 4,615,191 | 10/1986 | Grandy | 70/26 |
| 4,831,860 | 5/1989 | Sheiman et al. | 70/312 |

*Primary Examiner*—Renee S. Luebke
*Assistant Examiner*—Suzanne L. Dino
*Attorney, Agent, or Firm*—Pennie & Edmonds

[57] ABSTRACT

A shackle leg changeable combination lock including clutches and combination wheels slidable to position therein for positive engagement in which the combination wheels are axially restrained in position by a removable cap held by a detent means. The cap is removable when a shackle leg is moved upwardly to an unlock position and the cap detent means is overcome by application of force.

2 Claims, 4 Drawing Sheets

CHANGEABLE ROTARY COMBINATION SHACKLE LOCK

This is continuation of application Ser. No. 07/472,693, filed Jan. 31, 1990 and now abandoned.

BACKGROUND OF THE INVENTION

Cable or chain combination locks of the type having means for setting or changing the combination have been known (U.S. Pat. Nos. 4,445,348 and 4,615,191). Other combination locks have included mechanisms described in U.S. Pat. Nos. 1,706,994; 1,898,947; 4,354,365; 4,441,346; and 4,831,860.

SUMMARY OF THE INVENTION

Broadly, the present invention includes a shackle combination lock that is readily partially disassembled when the shackle is pulled to the open position to permit change of the combination. A cap end is removable by causing the depression of a spring-loaded clasp permitting the combination wheels to be removed from the clutches and replaced in a selected position to attain the desired new combination.

It is a feature of the lock that the removable cap is securely held by the lock shackle in the lock position and readily removable when the shackle is in the unlock position.

Figure 2:
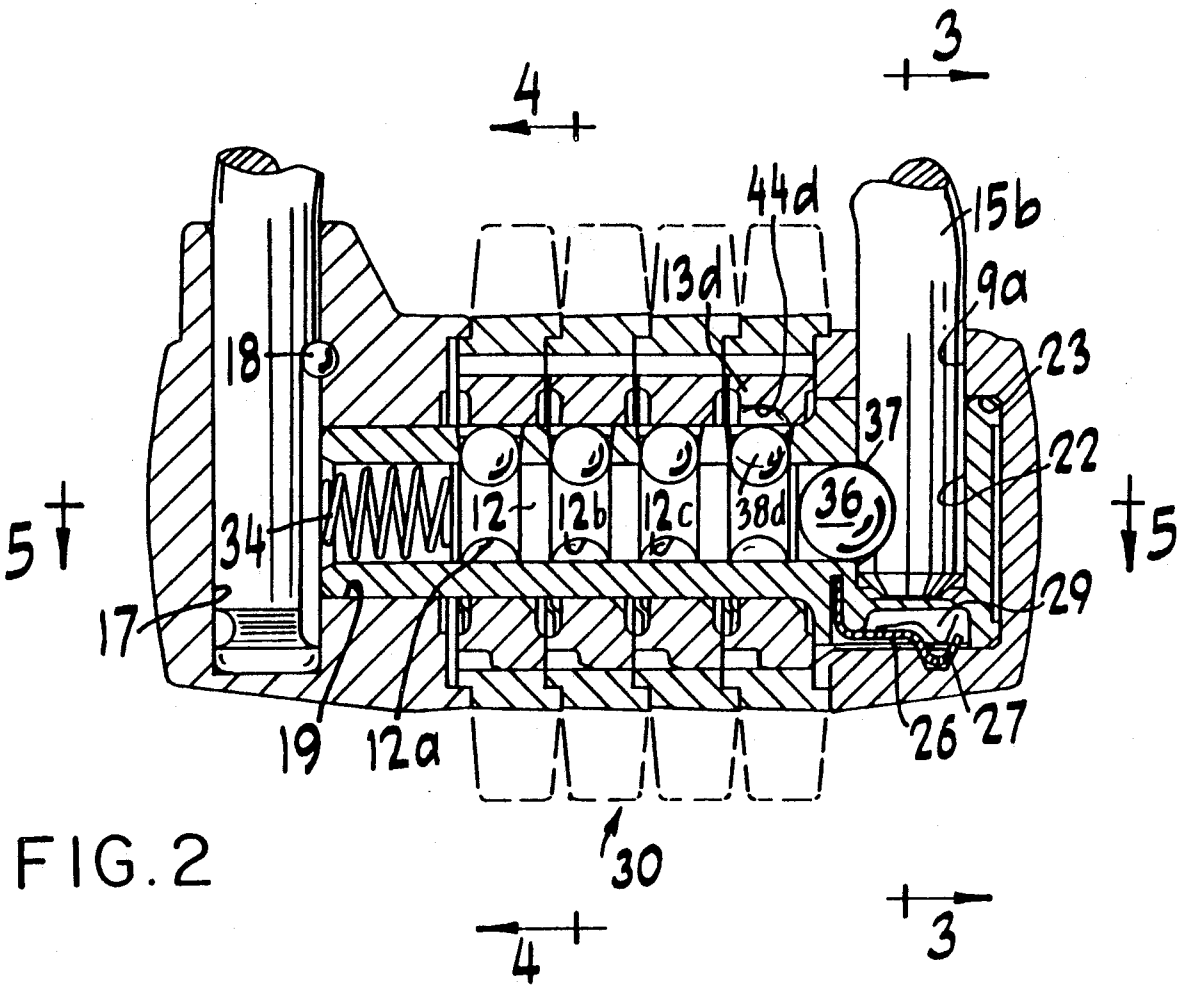
FIG. 2 is a partial elevational sectional view of the lock.
Figure 4:
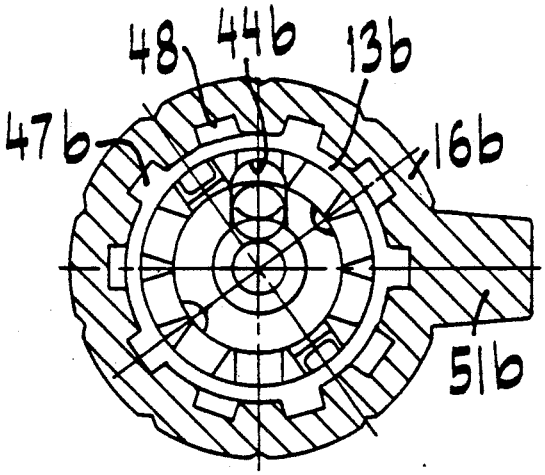
FIG. 4 is a sectional view along line 4—4 of FIG. 2.
Figure 5:
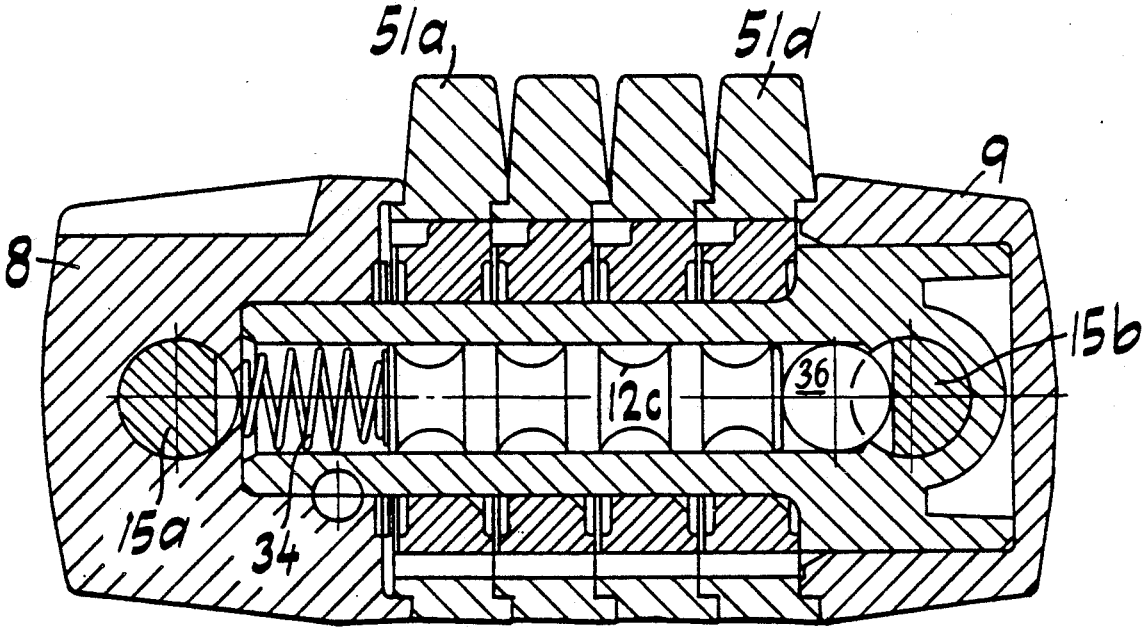

FIG. is a selected view along line 5—5 of FIG. 2; and

Figure 1:
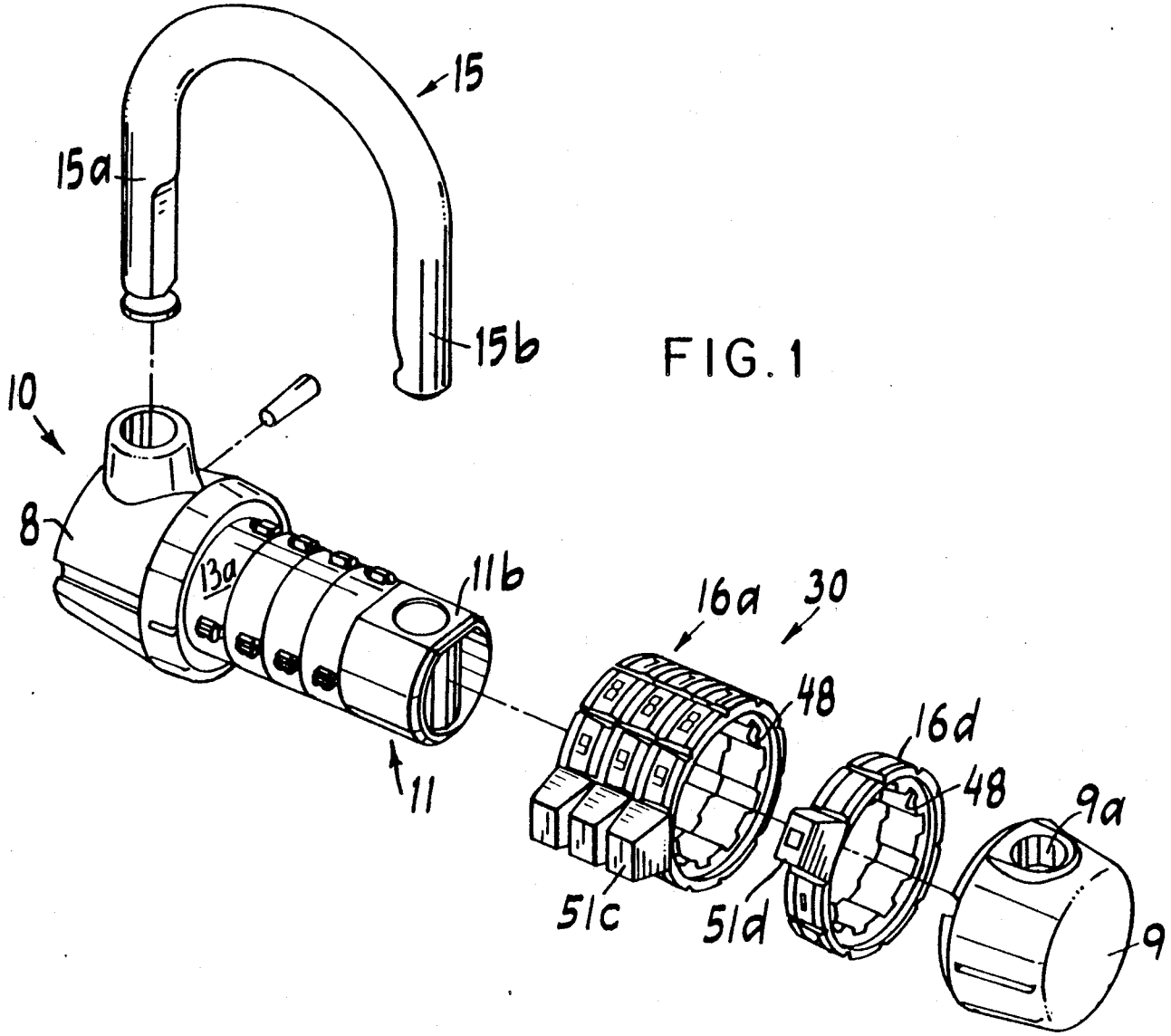
FIG. 1 is an exploded perspective view of selected parts of the lock.
Figures 1A, 6:
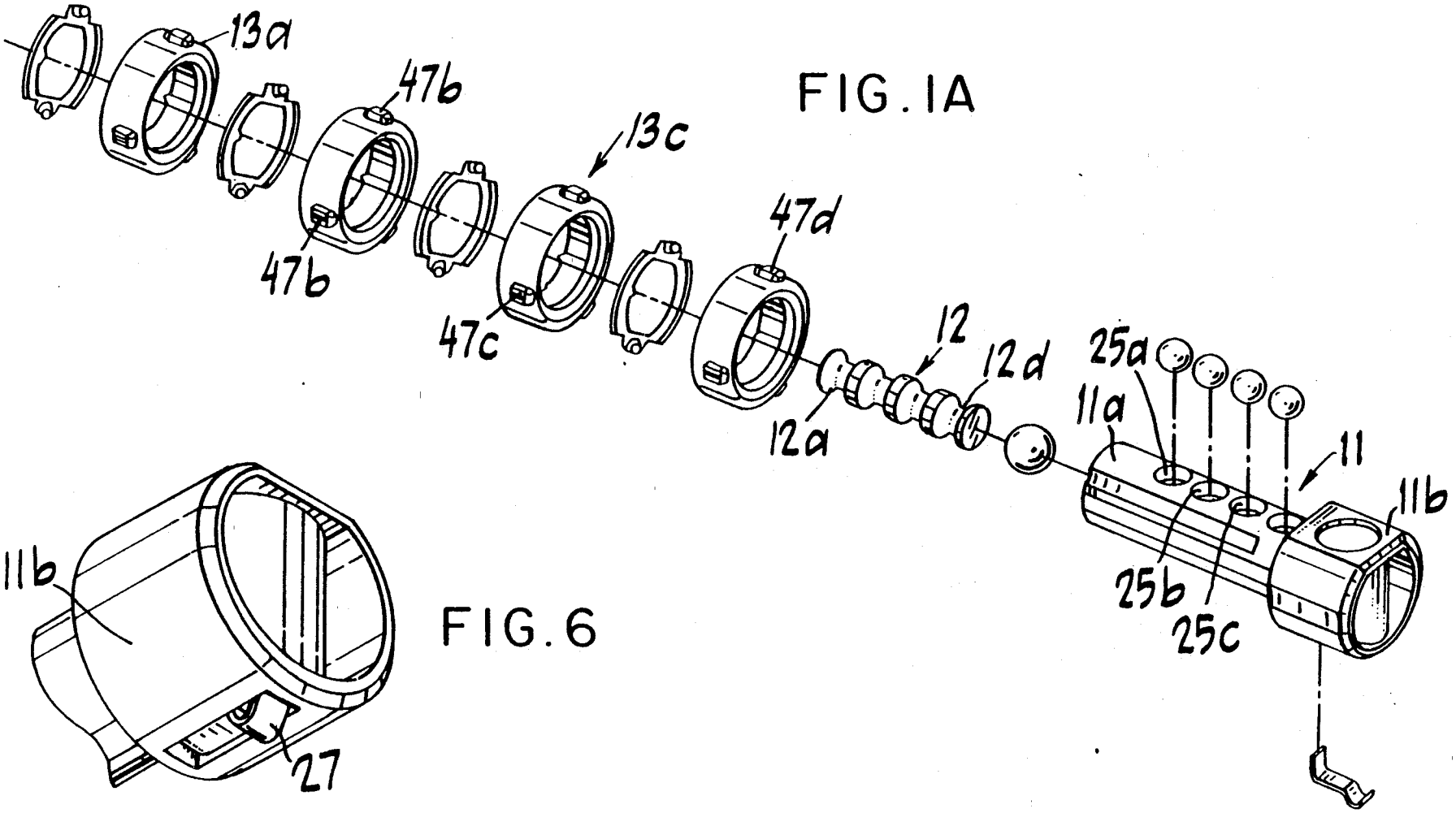
FIG. 1A is also an exploded perspective view of certain parts of the lock.
Figure 3:
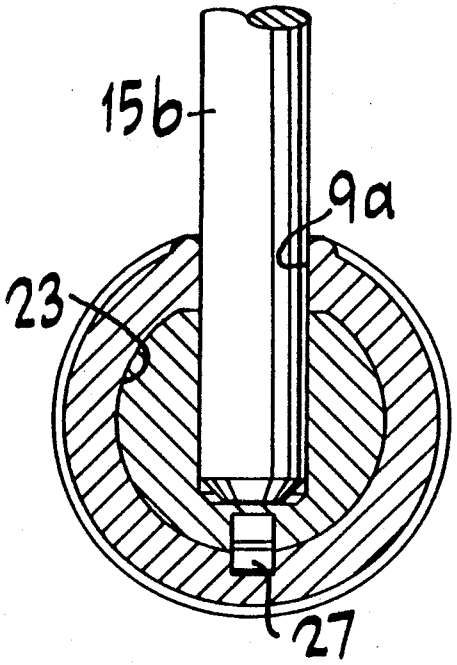
FIG. 3 is a sectional view along line 3—3 of FIG. 2.

FIG. 6 is bottom perspective of the lock cap.

DESCRIPTION OF THE PREFERRED EMBODIMENT

In FIGS. 1 and 1A, lock 10 includes fixed body portion 8, removable cap end 9, lock shaft body 11, lock shaft 12, clutches 13*a–d* and, combination wheels 16*a–d*, and U-shaped shackle 15 with shackle legs 15*a*, 15*b*. Shaft body 11 includes shaft portion 11*a* having both holes 25*a–d* and head 11*b*. Lock shaft body 11 is permanently fixed to body portion 8 using a pin or other suitable means.

Fixed body portion 8 in turn includes shackle sleeve opening 17, shackle leg retaining pin 18 and shaft body recess 19 (FIG. 2). Removable end cap 9 has shackle cap recess 9*a* and lock shaft body head 11*b* includes shaft recess sleeve 22 aligned to receive leg 15*b*. Cap a also has recess 23 to house head 11*b*.

Removable end cap 9 is held in lock position by shackle leg 15*b*; however, when leg 15*b* is moved out of head 11*b* and cap 9, cap 9 is readily removable by the exertion of force to cause cap 9 to be urged away from shaft body head 11*b* causing spring 26 to move out of lock cap cavity 27 into head dwell recess 29.

Lock 10 further includes locking mechanism 30 in which shaft 12, housed in shaft body recess 19 of shaft body portion 11*a*, is urged to the right (FIG. 2) by coil spring 34 causing large shackle lock ball 36 to engage shackle notch 37 of shackle leg 15*b*. Shaft 12 includes four (4) annular shackle depressions 12*a–d* for accommodating small shaft lock balls 38*a–d*. Lock balls 38*a–d* are captured in depression 12*a–d* and restrained by clutches 13*a–d*. Each clutch 13*a–d* includes a ball clutch pocket 44*a–d* which permits shaft lock balls 38*a–d* to be moved out of shaft grooves 12*a–d* to permit spring 34 to be compressed as shackle leg 15*b* is pulled upwardly camming ball 36 to the left (see arrow in FIG. 2) to unlock the lock. FIG. 2 shows the clutches 13*a–d* positioned with clutches 13*a–c* in positions in which balls 38*a–c* can not move upwardly out of grooves 12*a–c* while clutch 13*d* is turned so that clutch pocket 44*d* permits ball 38*d* to move upwardly upon laterally movement of shaft 12. Clutches 13*a–d* are moved to selected positions by combination wheels 16*a–b* which are engageable as clutch projections 47*a–d* enter wheel recesses 48. Clutches 16*a–d* also carry thumb pieces 51*a–d*.

Once the combination wheels 16*a–d* are aligned to permit balls 38*a–d* to be moved upwardly, a pull on shackle 15 causes shackle leg 51*a* to move upwardly camming ball 36 to the left (FIG. 2) to release leg 15*b*. As leg 15*b* is moved upwardly out of cap recess 9*a* and head recess 22, cap end 9 is free to be disassembled by applying sufficient force to cause spring 27 to move into dwell recess 29 and release cap 9.

Once cap end 9 is removed, combination wheels 16*a–d* can be removed laterally and replaced with each of the sets of projections 47*a–d* moved into a number of wheel recesses 48 on clutches 13*a–d* to create a new combination.

I claim:

1. A changeable combination U-shaped shackle lock in which the shackle has two legs and further has clutches and combination wheels comprising a) a fixed body having a shaft means for receiving and holding a first shackle leg in the fixed body for limited movement therein and said fixed body including a head means sized and proportioned to permit the combination wheels to be placed around and removed from the shaft means and said fixed body having a recess sleeve receiving a second shackle leg;

b) the shaft means having a hollow shaft recess extending therethrough;

c) a reciprocal shaft positioned in the hollow shaft recess, which shaft is normally urged toward the second leg located in the head means;

d) a ball between the reciprocal shaft and second leg to lock the second leg;

e) a removable spring-loaded cap positionable on the head means which cap is sized and proportioned to prevent removal of the combination wheels from the shaft means and includes a recess opening substantially perpendicular to the path of reciprocation of the shaft means, such opening for receiving the second leg which recess opening is aligned with the recess sleeve; such cap upon removal allowing removal of the combination wheels; and f) spring-loaded detent means for holding the cap on the head means after the lock is in its unlock position with the second leg removed from the head means and the cap;

whereby the head means, cap and second leg engage when the lock is locked and second leg and cap do not engage when the lock is unlocked permitting cap removal only upon activation of the detent means following shackle unlocking.

2. The lock of claim 1 in which the shaft has grooves, the shaft means includes holes and the clutches have pockets, all for accommodating lock balls.

* * * * *